US008356482B2

(12) United States Patent
Duval et al.

(10) Patent No.: US 8,356,482 B2
(45) Date of Patent: Jan. 22, 2013

(54) METHODS FOR THE PROTECTION OF A THERMAL BARRIER COATING SYSTEM AND METHODS FOR THE RENEWAL OF SUCH A PROTECTION

(75) Inventors: Sophie Duval, Zurich (CH); Piero-Daniele Grasso, Oberweningen (CH); Alexander Stankowski, Siggenthal-Station (CH)

(73) Assignee: ALSTOM Technology Ltd., Baden (CH)

( * ) Notice: Subject to any disclaimer, the term of this patent is extended or adjusted under 35 U.S.C. 154(b) by 946 days.

(21) Appl. No.: 12/420,123

(22) Filed: Apr. 8, 2009

(65) Prior Publication Data

US 2010/0242477 A1 Sep. 30, 2010

(30) Foreign Application Priority Data

Mar. 26, 2009 (EP) ..... 09156358

(51) Int. Cl.
*F01K 13/02* (2006.01)
*F01D 1/02* (2006.01)

(52) U.S. Cl. ..... 60/646; 60/657; 415/200

(58) Field of Classification Search ..... 60/646, 60/657; 415/200; 427/248.1, 255.19, 453, 427/585, 397.7, 419.2, 472, 376, 376.1
See application file for complete search history.

(56) References Cited

U.S. PATENT DOCUMENTS

| | | | | |
|---|---|---|---|---|
| 6,428,280 | B1 * | 8/2002 | Austin et al. | 416/241 B |
| 6,720,087 | B2 * | 4/2004 | Fried et al. | 428/614 |
| 2009/0053069 | A1 * | 2/2009 | Barnikel et al. | 416/241 R |

FOREIGN PATENT DOCUMENTS

| | | |
|---|---|---|
| EP | 1428902 | 6/2004 |
| EP | 1710398 | 10/2006 |
| EP | 1780308 | 5/2007 |
| EP | 1806436 | 7/2007 |
| WO | WO96/31293 | 10/1996 |
| WO | WO01/83851 | 11/2001 |
| WO | WO2006/137890 | 12/2006 |

OTHER PUBLICATIONS

Search Report from European Patent App. No. 09156358.5 (Sep. 11, 2009).

Cernuschi, F., et al., "Modelling of thermal conductivity of porous materials: application to thick thermal barrier coatings," J. Eur. Ceramic Soc. 2004, vol. 24, pp. 2657-2667, Elsevier Ltd., New York, US.

* cited by examiner

*Primary Examiner* — Hoang Nguyen
(74) *Attorney, Agent, or Firm* — Cermak Nakajima LLP; Adam J. Cermak

(57) ABSTRACT

A method for the application and/or renewal of a protection for a thermal barrier coating system of a heat engine involves a thermal barrier coating system that includes a bond coat layer (2) and a thermal barrier coating layer (3) of porous structure (4), wherein the bond coat layer (2) is located between and in contact with a base metal (1) of a heat engine component and with the thermal barrier coating layer (3) and bonds the thermal barrier coating layer (3) to the base metal (1). At least one substance is applied inside the engine as a liquid or carried by a liquid by spraying and/or by flowing it across a hot gas exposed surface (9) of the barrier coating layer (3) of the heat engine component mounted within the heat engine in the assembled state prior to the initial start-up of the engine, before the first operation interval, or during a washing cycle of the thermal engine and/or at the end of an operation interval, before a subsequent operation interval, wherein the substance covers and/or at least partly penetrates into the porous structure (4), and concomitantly or subsequently hardens to remain within the pores (4) and/or on the upper surface (9) of the thermal barrier coating layer. Preferably, but not necessarily, for the application, the turbine washing equipment of the engine is used.

35 Claims, 8 Drawing Sheets

METHODS FOR THE PROTECTION OF A THERMAL BARRIER COATING SYSTEM AND METHODS FOR THE RENEWAL OF SUCH A PROTECTION

This application claims priority under 35 U.S.C. §119 to European application no. 09 156 358.5, filed 26 Mar. 2009, the entirety of which is incorporated by reference herein.

BACKGROUND

1. Field of Endeavor

The present invention relates to a method for assuring a durable (i.e., essentially during the complete operation interval) protection of thermal barrier coating systems and base metal parts of gas turbines and other heat engines, in particular from the deleterious effect of environmental contaminants present in the gas flow. In particular, the invention relates to a method of applying a protection on the ceramic surface and of renewing this protection regularly on-site.

2. Brief Description of the Related Art

Thermal barrier coatings (TBC) are commonly deposited onto parts of gas turbines and other heat engines in order to reduce the heat flow on the base metal. Materials such as Y-stabilized zirconia (YSZ) are frequently chosen for their intrinsically low thermal conductivity. An appropriate microstructure (i.e., porosity and pore geometry) can additionally enhance their insulating and strain tolerance properties (for example, as disclosed in an article in the Journal of the Ceramic Society 24 (2004) entitled "Modeling of thermal conductivity of porous material: Application to thick thermal barrier coatings").

In the case of operation under extreme conditions (e.g., crude oil, heavy oil, presence of sand, sea water, etc.), porosity (and cracks) can be detrimental to the lifetime of the TBC system. Contaminants can infiltrate and diffuse into pores (and cracks), potentially inducing mechanical stresses and/or reaction with the TBC and/or with the bond coat (BC) and/or with the thermally grown oxide (TGO) layer. As a result, TBC spallation and/or bond coat corrosion may occur.

Consequently, a compromise has to be reached regarding the TBC microstructure, providing a balance between a highly open structure for an optimal thermal/mechanical management and a sufficient cyclic lifetime, and a dense or closed structure for a suitable protection against contaminants.

Environmental barrier coatings involving sealing, i.e., applying an impermeable layer onto the TBC system, are possible to protect the system against contaminants.

Different approaches have been followed so far:

Infiltration of the porosity of the TBC. Especially in the case of an APS (atmospheric plasma spraying) deposited layer, the horizontal fine pores are difficult to infiltrate. For wet processing, WO 2006/137890 proposes to immerse the substrate in a bath containing the solution and to subsequently apply vacuum in order to improve the infiltration.

Addition of one or several dense layer(s) on top of the TBC. A metallic layer in U.S. Pat. No. 5,169,674, composites in U.S. Pat. No. 5,851,678, or ceramics in WO-A-2001/83851, are for instance deposited on top of a TBC layer for such purpose.

Variation of the microstructure of the TBC layer as, e.g., disclosed in EP-A-1780308.

Remelting the uppermost layer of the TBC by laser glazing as, for example, in U.S. Pat. No. 6,933,061 or laser remelting as disclosed in U.S. Pat. Nos. 5,484,980 and 6,103,315.

All approaches of the state-of-the-art are used off-site, i.e., are applied prior to mounting the protected parts and operating the machine, and they aim to prevent (or at least to render more difficult) the penetration of contaminants through the TBC layer by closing the surfacial open microstructure of the TBC.

Some of them claim that their system acts not only as a physical barrier but also as a reactive barrier against contaminants. The reactants (mainly involving alumina) react with corrosive species and increase as a result their melting point and/or their viscosity and prevent them from penetrating deeper into the TBC. Such so-called sacrificial oxide coatings are for instance described in U.S. Pat. Nos. 6,261,643, 5,660,885, and 5,773,141, and WO-A-96/31293.

Since sacrificial coatings are consumed due to reaction, their durability is clearly an issue. Under extreme conditions, such as for operation under crude or heavy oils with possible sand infiltration, erosion tremendously affects coatings. In general, all sealants mentioned above tend to have a reduced thermal cycling resistance and a reduced total lifetime mainly due to the decreased strain tolerance of the system. Thus, the benefit of sealing against contaminants is generally only temporary and insufficient to withstand one complete operation interval. In consequence, the state-of-the-art protections are degraded very fast and the available technologies have not proved to perform to expectations.

SUMMARY

One of numerous aspects of the present invention includes a method which allows to assuring improved protection of thermal barrier coating systems (inclusive of bond coat) and base metal by providing a barrier, in particular a physical barrier and/or a chemical barrier onto the thermal barrier coating and/or at least partially within the porosity of the thermal barrier coating being used in a hostile environment, such as in a gas turbine operating under crude or heavy oil, with possible sand infiltration, in engines. Another aspect includes a method which allows the easy and regular renewal of such a protection.

Another aspect includes a method for the establishment and/or renewal of a protection onto a thermal barrier coating system of a heat engine, such as a gas turbine.

An exemplary thermal barrier coating system embodying principles of the present invention comprises a bond coat layer and a thermal barrier coating layer of porous structure, wherein the bond coat layer is located between and in contact with a base metal of a heat engine component and with the thermal barrier coating layer, and bonds the thermal barrier coating layer to the base metal.

Another aspect of the present invention includes the application of at least one substance to the thermal barrier coating layer on the heat engine component inside the engine as a liquid, or carried by a liquid, by spraying and/or by flowing it across a hot gas exposed surface of the barrier coating layer. This takes place on the heat engine component mounted within the heat engine (i.e., in the assembled state) either prior to the initial start-up of the engine, and/or during a washing cycle and/or before a next subsequent operation interval of the heat engine. Subsequently, the substance covers and/or at least partly penetrates into the porous structure of the thermal barrier coating layer, and concomitantly or subsequently hardens to remain within the pores and/or on the upper surface of the thermal barrier coating layer.

The substance, which can preferably be a sealing substance, a reactive substance, or a combination thereof, in this process may at least partly penetrate into the porous structure, and subsequently hardens on and/or within this porous structure to remain firmly attached within the pores and/or on the upper surface of the thermal barrier coating layer.

From a general point of view, the following definitions of terms shall be used for the understanding and interpretation of the present disclosure and the claims:

| | |
|---|---|
| Physical barrier: | layer structure on top of or partially penetrating into and attached to the thermal barrier coating layer, which layer structure prevents contaminants present in the hot gas path from penetrating into the thermal barrier coating layer and/or to the bond coat layer. In other words, the physical barrier essentially closes the path for contaminants present in these processes. This means that, for the contaminants present in these processes, the physical barrier is essentially impermeable, which however does not necessarily mean that it is fully dense. The physical barrier layer is usually consumed during operation by erosion. |
| Sealing substance: | a substance which can be applied as a liquid or carried by a liquid (solution, suspension, emulsion, or the like) to the surface of the thermal barrier coating for the formation of a physical barrier. |
| Chemical barrier: | layer structure on top of or partially penetrating into and attached to the thermal barrier coating layer or chemicals anchored in or on the thermal barrier coating layer, which prevents contaminants present in the hot gas path from penetrating into the thermal barrier coating layer and/or into the bond coat layer. The chemical barrier prevents this penetration by reacting with the contaminants. Correspondingly, the chemical barrier can in principle be porous; however, the chemical barrier prevents penetration by chemical reaction. The chemical barrier layer is usually consumed during operation mainly by reaction with contaminants. |
| Reactive substance: | substance, which can be applied as a liquid or carried by a liquid (solution, suspension, emulsion, or the like) to the surface of the thermal barrier coating for the formation of a chemical barrier. |
| Turbine washing: | during turbine washing, a liquid, normally water, optionally supplemented by adapted additives such as a detergent, is sprayed into the turbine hot gas inlet of the engine using the turbine washing equipment of the engine. |
| Washing cycle: | during a washing cycle, the engine is shut down or at least partially shut down (normally cooled down below 80° C.) and turbine washing takes place. In particular in case of engines operating with crude oil, regular washing cycles are performed in order to remove the deposits and, consequently, recover engine performance. The frequency of the washing depends on the power drop. It can, e.g., be scheduled every week. |
| Operation interval: | interval of operation of the engine. During one operation interval one or several washing cycles can take place. Within an operation interval, inspections (and in some cases, maintenance work) can be carried out. At the end of an operation interval, the engine is completely shut down, and inspection and maintenance work are carried out. Engines normally have operation intervals of more than 24000 hours. |
| Hardening: | process of solidification of the substance (sealing substance or a reactive substance). Solidification normally takes place during or after evaporation of the carrier liquid and it can take place via polymerization, cross-linking, oxidation, or a combination of these processes, of the substance alone. Hardening normally takes place between room temperature and the operating temperature of the engine. In the context of the present invention, while hardening may take place during and immediately subsequently to the actual application of the substance in the liquid, it will mainly take place when the engine is restarted and elevated temperatures are reached, and hardening may still take place during the first hour of operation at operation temperature. The sealing and reactive substances can also be hardened before the restart under the influence of exposure to air, heat (e.g., flame treatment, resistive heating, etc.), irradiation (e.g., UV and/or IR irradiation), hardening agents, or a combination thereof. |

In this context the following general considerations furthermore seem worthwhile mentioning.

No or limited damages of turbine blades must be achieved in order to be able to run the next operation interval and/or to have reconditionable blades.

Several washing cycles as defined above can be carried out during one operation interval. The aim of the turbine washing during such a washing cycle is to remove deposits formed due to contaminants from fuel (especially when crude oil is used), air, and additives in order to recover performance.

It is as such known that under operation with crude oil (or other fuel with heavy contaminants) and under specific environmental conditions, the TBC system has to be protected from contaminants (from the oil, the additives, or from the environment). The state-of-the-art method of protection is to apply to the TBC system a "protection" (several protection types are possible) exclusively off-site either before mounting the components and/or before starting a subsequent operation interval. So the protection system according to the state-of-the-art is not renewed before the end of an operation interval.

A general issue is that erosion and other effects occur generally in engines and remove or degrade the physical and chemical barriers rather rapidly. Another issue is additionally specific to the chemical barrier type of protection. The reactive species are consumed by reactions with the contaminants. Therefore, in order to have protection which lasts at least for an operation interval, a sufficiently thick layer of the protective material has to be applied. However, a thick layer is not desired since the strain tolerance of the system is concomitantly reduced. Consequently, according to the state-of-the-art, a rather unfortunate compromise as concerns the layer thickness has to be made in order to balance the strain tolerance and the early consumption of the layer. In fact, in practice such a compromise cannot be achieved and the protection does not survive the time of an operation interval (especially for strongly exposed areas).

Systems embodying principles of the present invention can protect the thermal barrier coating as well as the bond coat durably (i.e., during essentially the complete operation interval) from penetration of contaminants into the thermal barrier coating and to the bond coat during the whole operation interval with the possibility of regularly restoring its activity, thereby promoting the lifetime of the thermal barrier coating system and of the metallic base material.

Exemplary methods include the use of sealing substances/reactive substances, which may preferably be inorganic monomers, and/or oligomers and/or polymers (e.g. silicates, zirconium oxynitrate, and yttrium nitrate precursors) and/or organic monomers, oligomers and/or polymers and/or oxides (e.g. alumina, yttrium stabilized zirconia) containing liquid media, but is not restricted to it. For example, sol-gel and slurry processes can be used for the formation of a barrier. In most cases, the barrier is predominantly formed under the influence of elevated temperature normally during the restart of the engine. The sealing and reactive substances can, however, also be hardened under the influence of exposure to air, heat (e.g., flame treatment, resistive heating, etc.), irradiation (e.g., UV and/or IR irradiation), hardening agents, or a combination thereof, before the restart. Formation of the solid barrier occurs by hardening.

In embodiments of the invention, the protection preferably is at least renewed during the washing cycles after the turbine washing procedure in one cycle. Preferably, therefore, the method is applied as a part of (or just after) a washing cycle, normally as the final and last step of a washing cycle prior to resumption of operation of the engine. So, preferably, the method is carried out using a washing schedule of the engine. Further preferably, this method is applied essentially at the end of every, or of the majority of, the washing cycles in one operation interval. Therefore the regular washing schedule is essentially used generally not only for turbine washing in order to recover engine performance but also for recovering the protection. Typically, the sealing substance and/or the reactive substance are applied after at least one conventional turbine washing (i.e., after washing the engine with water and optionally with adapted additives), so after a turbine washing process using liquid without sealing substance and/or reactive substance.

So generally speaking, regular renewal of the protection against contaminants from the fuel and environment is proposed, using the washing schedule and preferably also using the washing equipment of the engine as normally already available. It is also possible to use the washing equipment exclusively for the turbine washing step, and further, specifically tailored equipment for carrying out the proposed method.

In order to perform the application or re-application of the protection, it is normally required to have the engine cooled down below 80° C. Therefore, preferentially one uses the opportunity that the engine is already cooled down for turbine washing purpose in order to perform the method. Carrying out the turbine washing before the method is furthermore beneficial since the blades are cleaner after washing and the protection can be applied more reliably. The turbine washing and the application of the protective layer is generally a 2-step process: first, during the washing cycle, the turbine is washed by carrying out the turbine washing; and second, the turbine blades are protected using a method in accordance with the present invention.

The proposed method for application or reconstitution of the protection is not restricted to being part of the washing cycle. It is also possible to apply the protection using the proposed method prior to the initiation of the very first operation interval of the engine. In this case, either preceded by a turbine washing step or not, the protective substances are applied prior to the initial start-up of the engine using the above-mentioned method.

A protection that can be obtained by methods in accordance with the present invention is a physical barrier and/or a chemical barrier, which latter includes anchored reactive substances.

Advantages that can be obtained are, among others, a good strain tolerance of the system due to a relatively thin coating, a more constant performance of the protection over the whole operation interval, reduction of the amount of scrap parts and related repair effort (due to no, or more limited, corrosion of the bond coat and no or limited degradation of the TBC), a potential double protection (chemical and physical barrier), and the possibility of protecting against different types of contaminants and/or degradation mode, a specific and modular protection against the erosion and the contaminant nature.

One possible exemplary concept according to a preferred embodiment, with one type of protection, includes the following steps:

1. A physical barrier or a chemical barrier is applied in the workshop.

2. The parts are mounted in the heat engine. The first operation interval is started.

3. The heat engine runs until the 1st washing cycle.

4. 1st washing cycle takes place. The engine is cooled down and the turbine washing takes place.

5. A liquid medium carrying or otherwise including the sealing substance or the reactive substance is injected into the hot gas path of the heat engine, preferably using the standard equipment for washing, i.e., the physical or chemical barrier is re-applied and the effect is renewed on-site and after a rather short operation time.

6. The heat engine is restarted.

7. Step 3 to 6 are repeated for each washing cycle (or every n-th washing cycle) until the end of the operation interval.

More generally speaking, according to this preferred embodiment for the washing cycle, the engine is cooled down, a turbine washing is carried out (i.e., without sealing substance and/or reactive substance), subsequently a liquid including and/or carrying at least one reactive substance or sealing substance is injected into the turbine using the standard equipment for washing, and subsequently the engine is restarted, wherein preferably these steps are repeated for each (or every n-th) washing cycle until the end of the operation interval is reached.

It should be noted also in the context of the following embodiments, that the initial physical barrier or chemical barrier does not necessarily have to be applied in the workshop already. It is also possible to mount the parts in the heat engine and then carry out a method according to the invention to, for the first time, apply the physical barrier or chemical barrier layer prior to the start of the first operation interval. This can be done either by carrying out the above-mentioned step 5 only, or by carrying out a turbine washing followed by step 5 prior to the start of the first operation interval.

Generally, the step of renewal (above step 5) guarantees that the efficiency of the reactive protection remains constant (or at least does not drop drastically) in order to eliminate or limit damages on the part.

One further possible exemplary method according to a further preferred embodiment, with two (or more) types of protection in combination, includes the following steps (in particular for highly contaminated and erosive environments):

1. A physical barrier and subsequently a chemical barrier are applied in the workshop. Alternatively a physical barrier and subsequently a second different physical barrier can be applied, or a chemical barrier and subsequently a second different chemical barrier can be applied. So, generally speaking, a first barrier and subsequently a second barrier are applied.

2. The parts are mounted in the engine. The first operation interval is started.

3. The heat engine runs until the 1st washing cycle.

4. 1st washing cycle takes place. The heat engine is cooled down, and the turbine washing takes place.

5a. A liquid media, which contains the material for the second barrier, is injected in the turbine, preferably using the standard equipment for washing, i.e., the second barrier is re-applied and the effect is renewed on-site and after a very short operation time.

6a. The engine is restarted.

7a. Steps 3, 4, 5a, and 6a are repeated n times until performance of the first barrier is affected.

8a. The next washing cycle takes place. The heat engine is cooled down, and the turbine washing takes place. A liquid media, which contains the material for the first barrier, is injected in the turbine using the standard equipment for washing, i.e., the first barrier is re-applied and the effect is renewed easily, on-site, and after a very short operation time.

9a. The engine is restarted.

10a. Steps 3, 4, 5a, and 6a are repeated until performance of the first barrier is affected.

11a. All the steps are repeated until end of the operation interval is reached.

More generally speaking, according to this preferred embodiment for the washing cycle, the engine is cooled down, a first turbine washing is carried out (i.e., without sealing substance and/or reactive substance), subsequently a liquid including and/or carrying at least one substance for the formation of the second barrier (can be chemical or physical) is injected into the turbine using the standard equipment for washing, and subsequently the engine is restarted, wherein preferably these steps are repeated during each (or every n-th) washing cycle until the performance of the first barrier layer is also affected, and then during a subsequent washing cycle, after a turbine washing, a liquid carrying at least one substance for the formation of the first barrier and (subsequently or concomitantly) optionally a substance for the formation of the second barrier is injected into the turbine using the standard equipment for washing.

It should be noted also in the context of the following embodiments, that the initial physical barrier or chemical barrier does not necessarily have to be applied in the workshop already. It is also possible to mount the parts in the heat engine and then carry out a method according to the invention to, for the first time, apply the physical barrier or chemical barrier layer prior to the start of the first operation interval.

Liquid reactive substances are applied after the standard turbine washing procedure with a similar procedure as for the turbine washing. The turbine washing step enables removal of some deposits and consequently to recover the engine performance. In the following washing step, the protection is renewed and the performances of the protection are recovered.

In a preferred embodiment of the invention, the renewed system is applied and hardened on-site.

In one embodiment of the invention, an assessment of the homogeneous deposition of the sealing or the reactive substances is performed. According to a further preferred embodiment, a colored indicator can preferably be added to the liquid media together with the substance of the invention in order to visually assess the homogeneous deposition and the status of protection. Generally speaking, the liquid and/or the sealing substances and/or the reactive substance and/or a further additive can be chosen such as to allow an optical, preferably a visual verification (by the naked eye) of the protection level and/or of the presence, extension, or homogeneity of the protection. Preferably to this end a colored indicator is added to the liquid together with a sealing substance and/or a reactive substance. Colored indicator means that the substance either changes color depending on the status of the protective layer, or it is colored and is removed/degraded together with the protective layer, or it develops color on consumption and/or deterioration of the protection layer. Color in this context includes black and white, the main aim being to be optically verifiable, preferably by the naked eye.

Preferably, the sealing and the reactive substances are self-hardening and/or self-curing. This property can be provided intrinsically (e.g., crosslinkable elements), and/or by initiators and/or crosslinkers present in a mixture forming the sealing substance.

The sealing and reactive substances can preferably be hardened under the influence of exposure to air, heat (e.g., flame treatment, resistive heating, etc.), irradiation (e.g., UV and/or IR irradiation), hardening agents, or a combination thereof. Most preferably the sealing and/or reactive substances are selected such that they are essentially liquid under application conditions (between room temperature and approximately 80° C.) either alone or including a carrier liquid, and such that they harden either subsequent to application, and/or during the initial stages of the restart of the thermal engine when the temperature is increasing, and/or normally final hardening takes place within the first few hours of normal operation at operation temperature, meaning that hardening takes place in a temperature range above application temperature up to the operating temperature of the engine.

Preferably, the sealing and/or reactive substances are selected from substances in a form of sol-gel, slurry, emulsion, dispersion, solution of polymeric/oligomeric/monomeric based materials, or a mixture thereof. The liquid media may contain a hardening agent selected from the group of: initiator, curing agent, and cross-linker. Preferably the sealing and the reactive substances can be cured. The sealing and reactive substances are further preferably in a carrier liquid from among an aqueous solvent, organic solvent, in particular ethanol, acetone, or a mixture thereof.

Furthermore the present invention relates to a heat engine component with a thermal barrier coating system comprising a bond coat and a thermal barrier coating with a porous structure, wherein the bond coat layer is located between and in contact with the base metal of the heat engine component and wherein the thermal barrier coating layer bonds the thermal barrier coating layer to the base metal. The porous structure is covered or at least partly infiltrated on a hot gas exposed surface thereof by a substance, preferably by a sealing substance and/or a reactive substance, which are applicable by spraying onto or flowing across the upper surface of the thermal barrier coating, preferably (but not necessarily) using the washing equipment of the engine such that the porous structure is partly infiltrated by said substance (sealing substance and/or said reactive substance) and subsequently concomitantly hardened therein/thereon, forming a physical and/or a chemical barrier for the typical contaminants in this field.

According to a preferred embodiment, the substance infiltrates the porous structure on the hot gas exposed surface thereof by a penetration thickness T which is preferably at least equal to the thickness of TBC, which was eroded in between two washing cycles and below 30% of the total thickness Z of the thermal barrier coating layer. Generally speaking the infiltration depth T is, alternatively speaking, at least equal to the roughness $R_t$ (maximum distance between the highest peak and the lowest valley) but not exceeding 30% of the total remaining TBC thickness.

According to yet another preferred embodiment, the sealing and/or reactive substances form a layer extending on and above the hot gas exposed surface of the thermal barrier coating layer, wherein preferably the thickness S extending above the surface of the thermal barrier coating layer is in the range of 2%-35%, preferably between 2%-25% of the total thickness of the thermal barrier coating layer. Also a combination of a penetration zone and layer extending above the hot gas exposed surface is possible.

Typically the thermal barrier coating layer thus comprises an essentially impermeable layer of the sealing substance (impermeable meaning impermeable for the contaminants in this field) and/or the above-mentioned chemical barrier layer.

Preferably such a system is initially established and/or renewed using a method as described above.

Furthermore the present invention relates to the use of at least one substance capable of being hardened for the initial application and/or renewal in the hot gas exposed surface region and/or on the hot gas exposed surface of a thermal barrier coating layer on a component of a heat engine, wherein during washing cycle(s), normally after a turbine washing, a substance (preferably a sealing substance and/or a reactive substance) is applied preferably (but not necessarily) using the washing equipment of the engine to the thermal barrier coating layer and subsequently hardened therein and/or thereon. Preferably subsequent hardening takes place mainly by the action of the heat generated by restarting the heat engine.

BRIEF DESCRIPTION OF THE DRAWINGS

The drawings will be explained in greater details by description of an exemplary embodiment, with reference to the following figures.

DETAILED DESCRIPTION OF EXEMPLARY EMBODIMENTS

Figure 1:
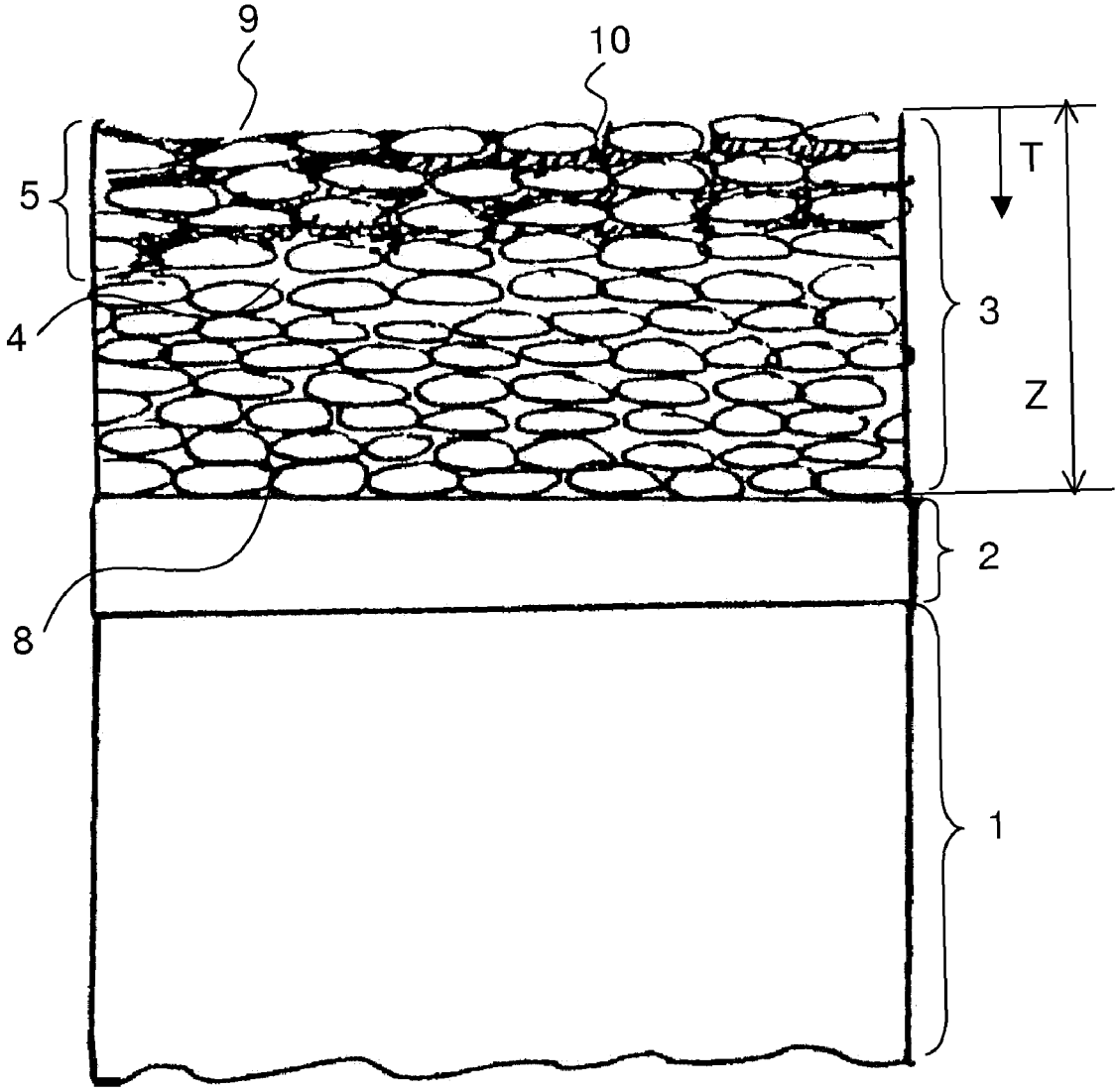
FIG. 1 shows a first embodiment of the present invention wherein the thermal barrier coating is infiltrated by the sealing and/or reactive substances.

With reference to the drawings preferred embodiments are discussed in the following. The drawings as well as the respective discussion serve as illustration for the preferred embodiments and shall not be construed as a limitation of the invention as defined in the appended claims.

In general terms, methods adhering to principles of the present inventin protect a thermal barrier coating system (inclusive of bond coat and metallic base material), wherein this protection can be applied in the workshop prior to installation, subsequent to initial installation when the components are already mounted in the engine, as well as during or part of washing cycles taking place during an operation interval, or at the end of an operation interval before a subsequent interval as conventionally carried out on the heat engine (e.g., a gas turbine). The corresponding physical and/or chemical barrier can thus be initially applied but also regularly renewed, and the physical and/or chemical barrier is, respectively, essentially impermeable to contaminants, i.e., they prevent diffusion/penetration of the contaminants (physical barrier) or the contaminants react with the barrier material and penetration is prevented thereby (chemical barrier).

An exemplary method includes a step of application of a substance such as a sealing or a reactive substance to a thermal barrier coating 3 during a washing cycle after the turbine washing of the heat engine preferably (but not necessarily) using the conventional washing equipment in order to provide a renewed (or initially applied) barrier. The method therefore allows renewal at brief intervals (i.e., during the washing cycles) thus preventing profound degradation of the protection, and which highly efficiently prevents penetration of contaminants into the thermal barrier coating and also to the bond coat layer during engine operation intervals.

The figures show a general structure of a thermal barrier coating system on a base metal 1 (e.g., the turbine blade base material), including a bond coat 2 (generally abbreviated BC) and a thermal barrier coating 3 (generally abbreviated TBC). The bond coat 2 acts like an adhesion promotion layer bonding the thermal barrier coating layer 3 with its lower (base metal facing) surface 8 to the base metal 1 surface. The upper (hot gas environment exposed) surface 9 of the thermal barrier coating 3 is in contact with the hot gases and in particular with contaminants resulting from crude oil or heavy oil combustion flowing across the corresponding TBC protected part of the heat engine.

FIG. 1 shows a first embodiment of a thermal barrier coating system to which the proposed method has been applied.

During a washing cycle, after the turbine washing using conventional liquid for the washing, a sealing substance is applied to the thermal barrier coating 3. For the application of the sealing substance, the conventional washing equipment of the engine is preferably used for the introduction of the liquid substance into the hot gas path of the engine. Thus, the sealing substance partially infiltrates into the porous structure 4 of the thermal barrier coating 3 and remains within pores of the porous structure 4. This is shown in the drawing figure by the infiltrated area 5. Another part forms a layer on top of the thermal barrier coating. The sealing substance in this way provides an essentially impermeable layer 10 within and on the thermal barrier coating 3.

Typically, not the whole thickness Z of the thermal barrier coating layer is infiltrated by the sealing substance, but rather only a surfacial section or partial layer thereof, as indicated by the arrow T. The thickness T of the infiltrated layer section 5 is typically in the range of less than 30% of the total thickness Z of the thermal barrier coating layer 3. Generally speaking the infiltration depth T is at least equal to the thickness eroded in between two cleaning periods. Preferably the infiltration depth is at least equal to the roughness $R_t$ (maximum distance between the highest peak and the lowest valley) but not exceeding 30% of the total remaining TBC thickness.

The sealing and reactive substances are applied at a typical application temperature in liquid form, such as a slurry or a sol-gel or solution or dispersion. The sealing substance can be applied as one single sealing substance in a liquid carrier or as a mixture of different sealing substances in a liquid carrier.

Possible types of liquid media systems with the substances are: sol-gel, slurry, dispersions, emulsions, solutions, as well as combinations thereof.

The liquid media is typically as follows: a solvent (e.g., an aqueous or organic solvent such as ethanol or acetone or mixtures of solvents), in combination with at least one or a combination of the following constituents: precursors (e.g., Al-isopropoxide), filler particles (e.g., yttrium stabilized zirconia or aluminum oxide), dispersant (e.g., polymer, e.g., solsperse), binder (e.g., polymer, e.g., PVB or waterglass), hardener (e.g., cross-linker, curing agent, initiator). Generally, liquid media are preferred having a viscosity between 0.3 mPa·s and 100 Pa·s, more preferably from 0.3 mPa·s to 50 Pa·s.

It is thus for instance possible to use a carrier liquid, for example water or ethanol or acetone, in which the actual sealing substance(s) is/are dissolved, suspended, and/or emulsified and thereby carried to the surface regions of the TBC coated parts to be treated for the formation of a solid physical barrier and/or chemical barrier layer.

Preferably the sealing and reactive substances (with carrier liquid) are sprayed onto the upper surface 9 of the thermal barrier coating layer 3 using the washing equipment of the engine during a washing cycle thereof after the turbine washing step. So the sealing and/or reactive substance can be applied by the typically, already existing conventional washing system of the heat engine. Thereby the sealing and/or reactive substance is carried across the upper surface 9 and contacts the upper surface of the thermal barrier coating 3 and thereby the sealing and/or reactive substance(s) can infiltrate into the porous structure and/or form a surfacial layer.

The sealing and reactive substances can be chosen such that they harden under exposure to air, for example due to cross-linking/polymerization reaction and/or that they harden upon the application of irradiation and/or heat (for example due to reaction of the substance such as cross-linking/polymerization initiated by irradiation/heat) and/or upon evaporation of the solvent. The use of heat for the hardening is particularly advantageous and easily possible in the present context when the method is applied to thermal barrier coating systems being arranged within heat engines, as for hardening the available heat of the engine can be used when the thermal engine starts up after the washing cycle or when starting a new operation interval. Once the sealing or reactive substances are hardened, they provide a physical or chemical barrier, which prevents the penetration of contaminants into and through the thermal barrier coating layer.

The sealing or reactive substances are preferably applied such that they infiltrate the porous structure of the thermal barrier coating 3 to a desired degree. In the embodiment shown with FIG. 1, the degree is defined as being a measure T extending from the upper surface 9 of the thermal barrier coating 3. Preferably the measure T is as detailed above, and for example in the range of ¼ to ⅓, in particular between ⅕ and ⅓ of the thickness Z of the thermal barrier coating 3. In general it is preferable to have a thin layer T in order to minimize negative effects such as strain within the layer or thermal conductivity by the sealing substance. Due to the regular application of the coating, for example during each washing cycle, it is possible to apply a much thinner layer.

It is possible to use a liquid media, which contains (as a further additive) or in itself is a color indicator (including black and white, the essense being that the substance distinguishes from the visual appearance of the underlying thermal barrier coating layer surface) the presence of which can be visually or optically verified. The advantage of using optically/visually verifiable liquid media is the fact that they allow checking the status of protection of the component easily and over the surface.

In order to provide a clean upper surface 9 as well as clean pore channel surfaces, it is usually beneficial in a washing cycle to first apply a turbine washing step to the thermal barrier coating and subsequently apply the sealing substance and/or the reactive substance in a separate subsequent step.

Figure 2:
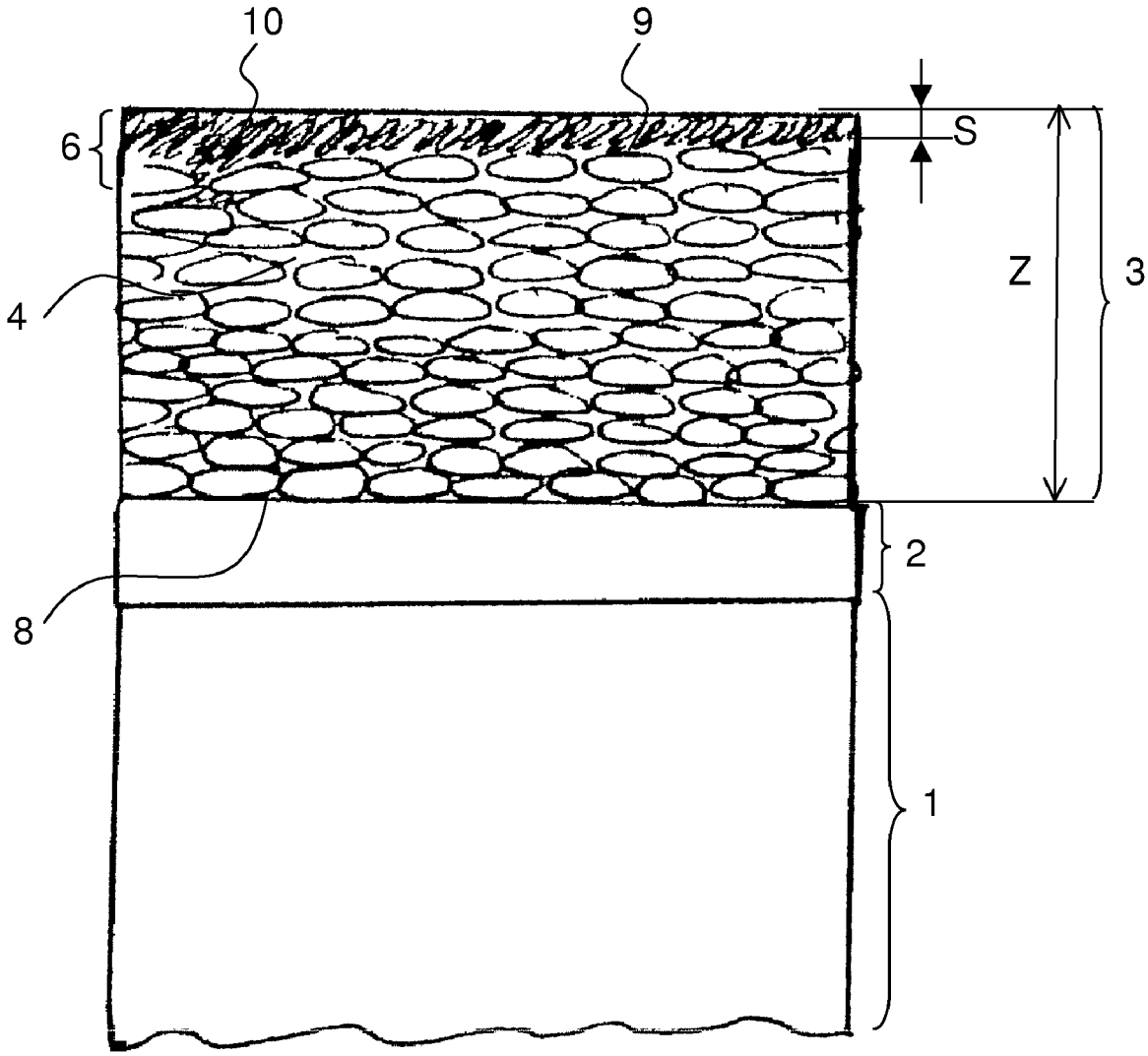
FIG. 2 shows a second embodiment of the present invention wherein sealing and/or reactive substances are on the thermal barrier coating.

Normally a two-step process during the washing cycle is preferred, for example an initial application of a washing medium without sealing and/or reactive substance (turbine washing step) followed by a phase in which the substance (reactive substance and/or sealing substance) is applied. FIG. 2 shows a second embodiment of the protection of a thermal barrier coating system. Identical elements are designated using the same reference numerals as with regard to the first embodiment illustrated in FIG. 1.

In the second embodiment the sealing or reactive substance which provides the impermeable layer 10 is applied such that it only marginally infiltrates the pores 4 adjacent to the upper surface 9 in order to provide a top coat 6 as an impermeable layer, i.e., a physical or chemical barrier. The substance can also be chemically reactive with the contaminants, forming a chemical barrier. The top layer 6 is substantially arranged on the upper surface 9 such that it extends over the upper surface 9 and only partly into the thermal barrier coating 3. Preferably in this case the top layer 6 forms a continuous layer completely covering the relevant surface of the thermal barrier coating layer.

The measure by which the sealing and/or reactive substances extend over the upper surface 9 (layer thickness essentially formed by sealing substance only) is illustrated by reference sign S. Preferably S is between 2% and 25%, in particular between 2% and 15%, of the thickness Z of the thermal barrier coating 3. Generally speaking, the layer thickness S is at least equal to the thickness eroded in between two cleaning periods. Preferably the top layer thickness is equal to the roughness $R_t$ (maximal distance between the highest peak and the lowest valley); but not exceeding 25% of the total thickness.

The method to apply the top coating 6 can be chosen to be identical to the one as described with regard to FIG. 1. However, the sealing and/or reactive substance is for this case typically chosen such that it has a higher viscosity or lower wetting properties that allow for the sealing and/or reactive substances to enter only into the uppermost pores of the thermal barrier layer 3 and not into the underlying pores. To this end the sealing and/or reactive substance should have a viscosity between 0.3 mPa·s and 100 Pa·s, preferably from 0.3 mPa·s to 50 Pa·s as given above.

Figure 3:
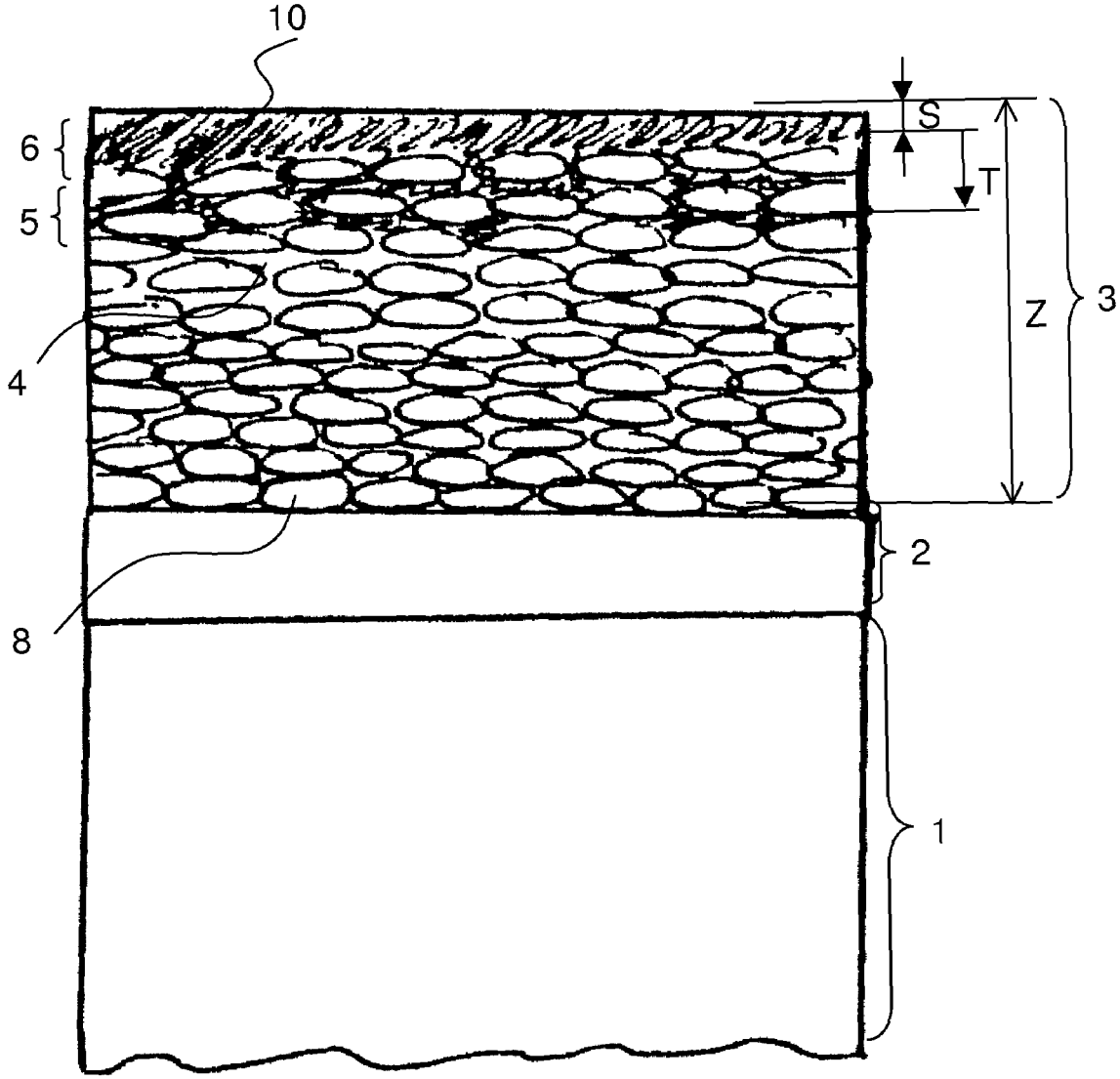
FIG. 3 shows a third embodiment of the present invention wherein the sealing and/or reactive substances are on and in the thermal barrier coating.

FIG. 3 shows a third embodiment of the thermal barrier coating system. In this embodiment the sealing and/or reactive substance is applied such that it infiltrates the thermal barrier coating 3 according to the first embodiment and that it additionally extends over the upper surface 9 as according to the second embodiment.

In this embodiment the thickness of the impermeable layer is defined as the sum of the thickness S and the measure T.

Figure 4:
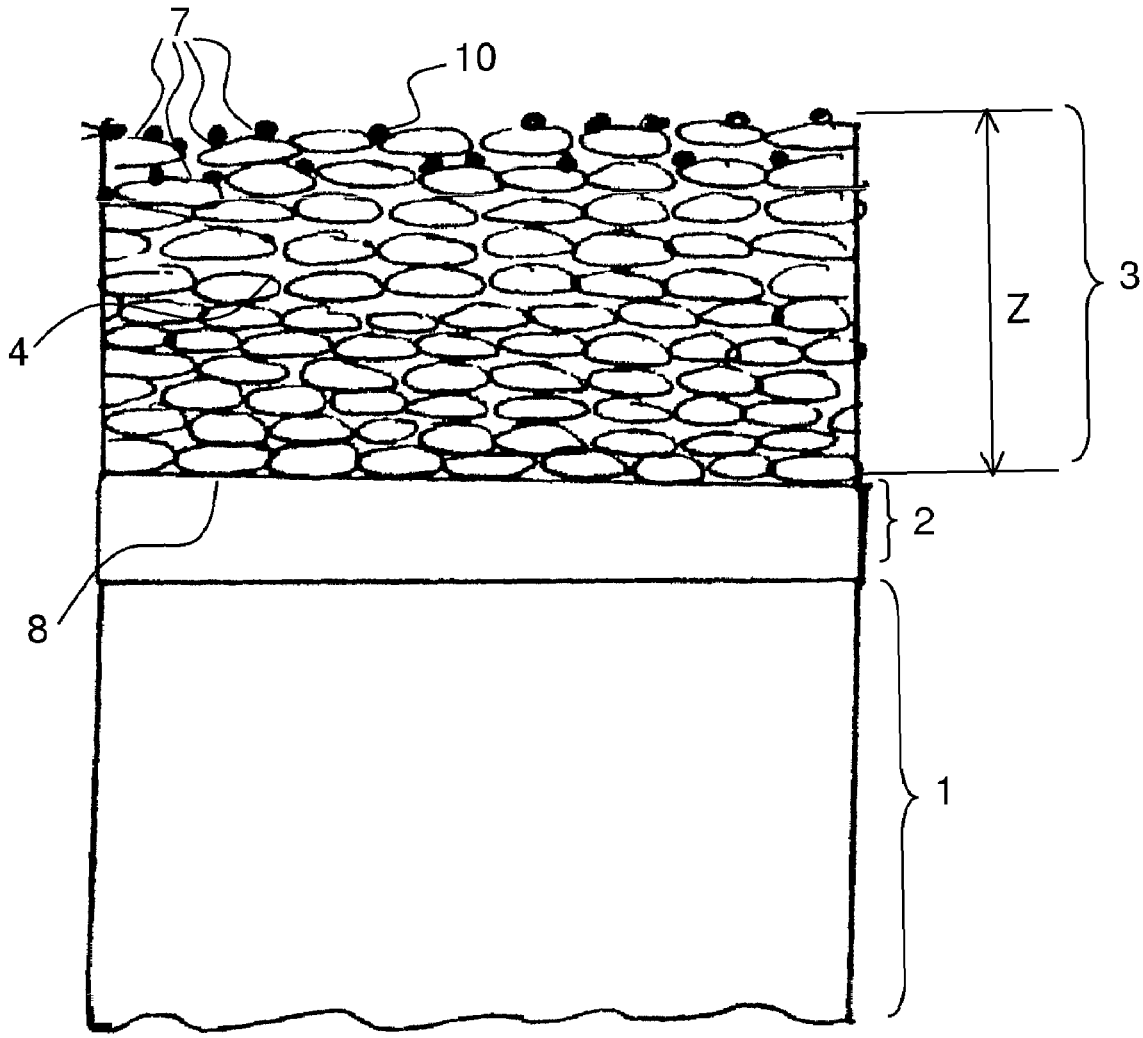
FIG. 4 shows a fourth embodiment of the present invention wherein reactive substances are anchored on the thermal barrier coating.

FIG. 4 shows a fourth embodiment of the present invention. In this embodiment the reactive substances 7 are anchored at the surface of the TBC and provide a chemical barrier to contaminants. The reactive substances are applied to the thermal barrier coating in essentially the same manner as described above.

The reactive substances are chosen such that they are reactive versus contaminants, in particular versus contaminants from crude or heavy oils and are able to immobilize them, preventing their penetration into the thermal barrier coating layer.

As the protective species are reactive they should be renewed frequently before the end of an operational interval.

Figure 5:
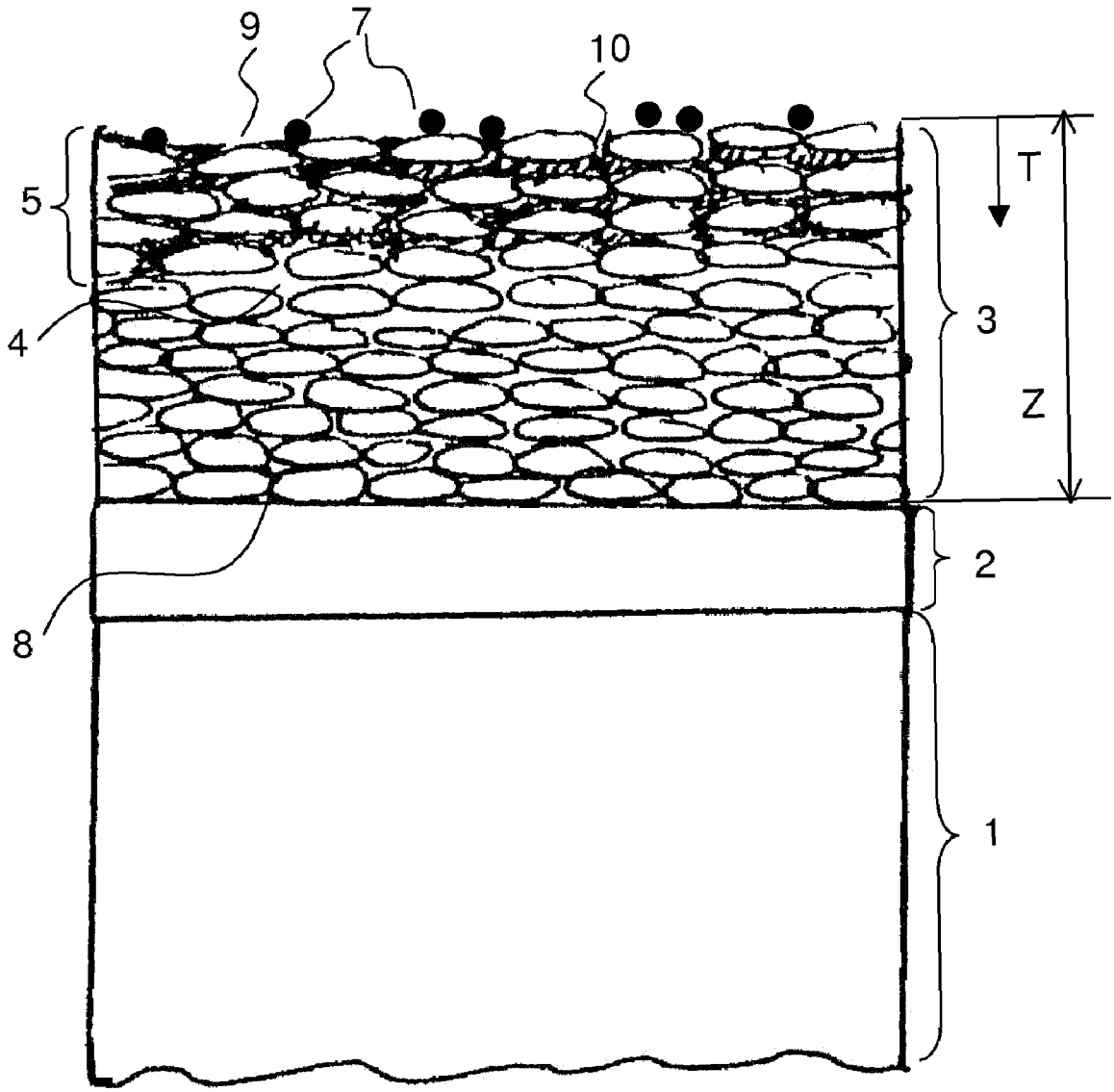
FIG. 5 shows a fifth embodiment of the present invention wherein the sealing and/or reactive substances are infiltrated into the thermal barrier coating and reactive substances are additionally anchored on/in the thermal barrier coating.
Figure 6:
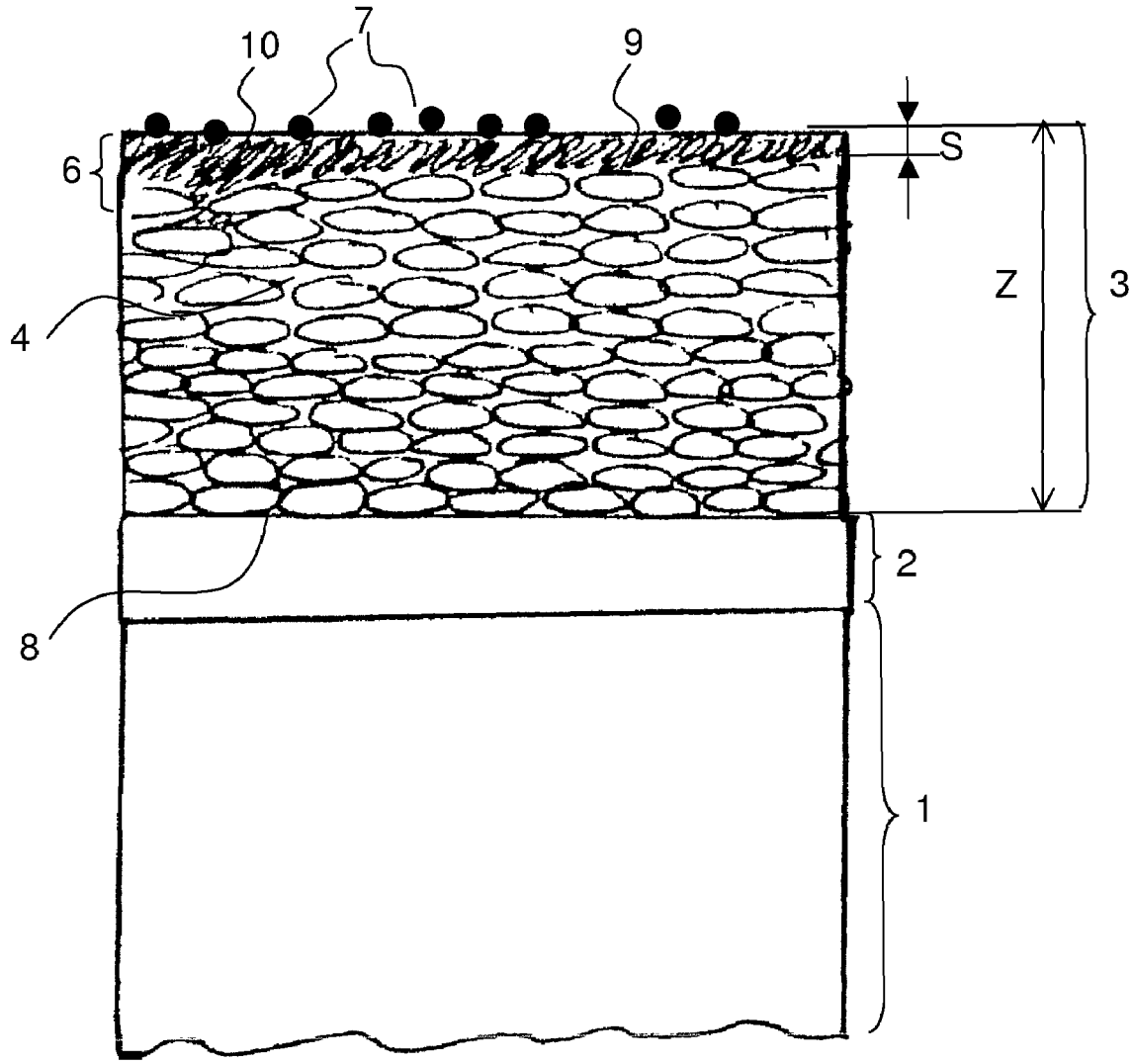
FIG. 6 shows a sixth embodiment of the present invention wherein sealing and/or reactive substances are on the thermal barrier coating and additionally, on the sealing and/or reactive substances, reactive substances are anchored.
Figure 7:
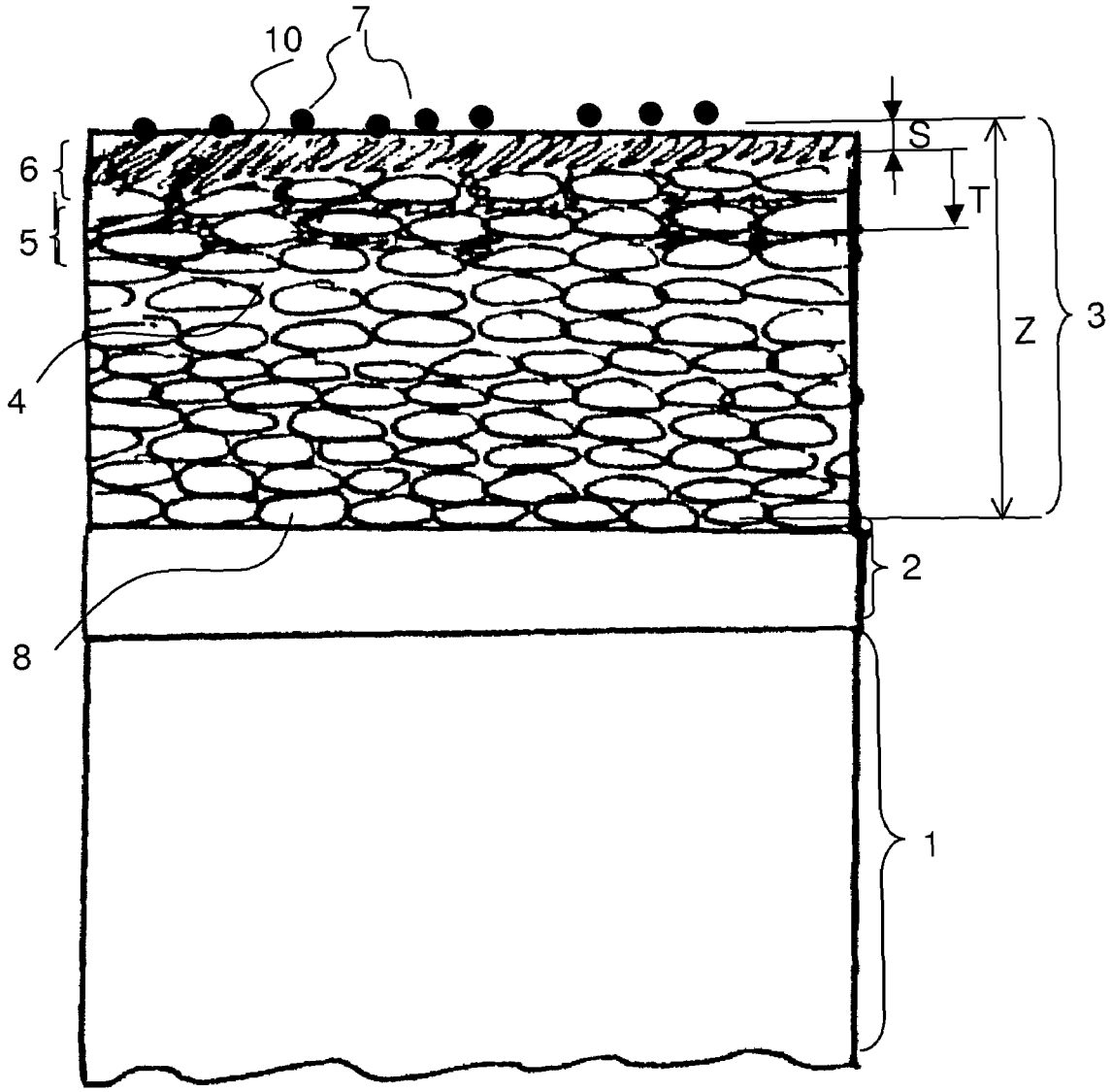
FIG. 7 shows a seventh embodiment of the present invention wherein sealing and/or reactive substances are infiltrated in the thermal barrier coating, are on the thermal barrier coating and additionally on top reactive substances are anchored.

The further embodiments as given in FIG. 5-7 essentially result from a combination of the first three embodiment as illustrated in FIGS. 1-3 with an anchoring of reactive species on the surface of the layer in accordance with the embodiment as illustrated in FIG. 4. These embodiments serve to show that the different possibilities can be combined depending on the needs and the degree of contamination in the hot gas path.

Figure 8:
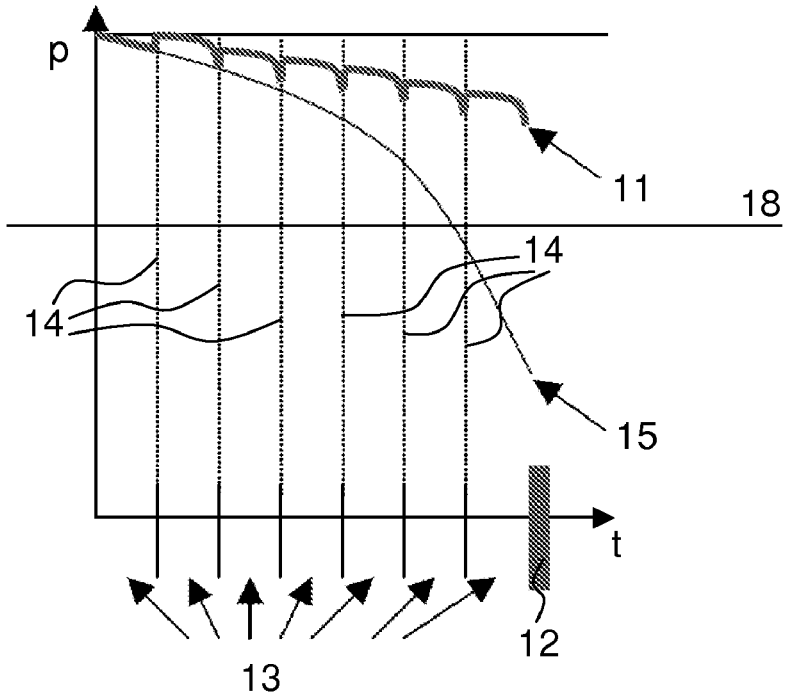
FIG. 8 illustrates temporal behavior of the protection level (p) of the thermal barrier coating layer and the bond coat layer using a protection method according to the invention and to the state-of-the-art.

General improvements provided by methods according to the invention are illustrated schematically in FIG. 8 for the situation where, in each washing cycle 14 until the end of the operation interval 12, the method according to the invention is applied, i.e., the physical and/or chemical barriers are at least partially renewed. If the protection is applied off-site according to the state-of-the-art and not renewed, the protection level shows a general temporal behavior as indicated by line 15, while if a method according to the invention is used, the decay of the protection level p can be substantially prevented as indicated by line 11. Therefore, with the state-of-the-art methods, a strong decrease of the efficiency of the protection results as a function of time, which can lead to heavy damage and a higher potential risk that parts are defective before the end of the operation interval in view of the impossibility of reconditioning them, but by utilizing methods according to the present invention, little or no decrease of the efficiency of the protection results. This opens up the possibility of reconditioning the component or to use the components longer. The horizontal line 18 indicates the limit below which the bond coat is severely corroded, thermal barrier coating spalls off, and the part cannot be reconditioned after the end of the operation interval. If the protection level is below this value, the necessary maintenance work increases dramatically. Using a protection method according to the state-of-the-art, it usually cannot be avoided that the protection level drops below line 18.

Examples of protection types are as follows.

The protective media, as applied with a method according to the invention, can be deposited in order to form:

a layer which is impermeable as obtained:

when the liquid media is infiltrated (see FIG. 1), when the liquid media is deposited on top of the TBC (see FIG. 2), a combination of FIG. 1 and FIG. 2 (see FIG. 3).

reactive substances anchored in and/or on the TBC (see FIG. 4), which reacts with contaminants, or a layer, which serves as a reservoir of reactants, as obtained with:

when the liquid media is infiltrated (see FIG. 1), when the liquid media is deposited on top of the TBC (see FIG. 2), a combination of FIG. 1 and FIG. 2 (see FIG. 3).

a combination of all or at least two of the foregoing.

One aspect of the sealing layer is to create an impermeable layer, impermeable meaning that contaminants are not allowed to penetrate the layer either by physical or by chemical interaction. An aspect of the chemical barrier coating is therefore to have chemicals available on the surface, which react with contaminants and prevent them from diffusing through all the TBC.

The most suited solution can be chosen according to the site and operation conditions (e.g., strong/low erosion).

Figure 9:
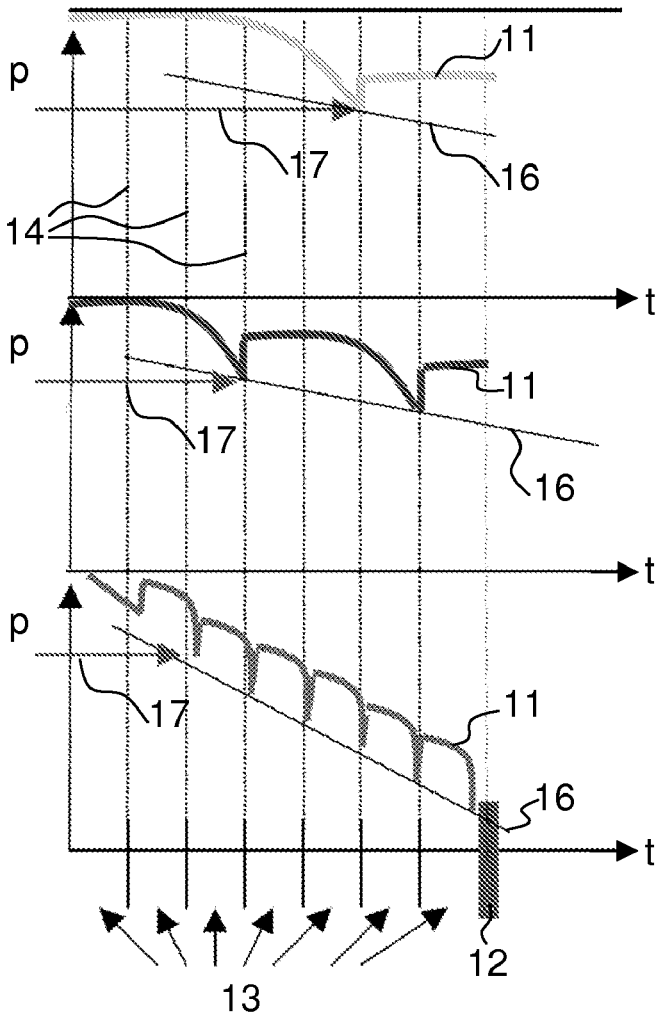
FIG. 9 illustrates temporal behavior of protection level (p) of the thermal barrier coating system for the different possibilities of structuring the application of the protection.

Examples of the efficiency with different protections as described in the various embodiments of the invention are given in FIG. 9. The protection level p of the thermal barrier coating system is given as a function of time t. In the uppermost illustration a situation is shown in which a double protection is used (see FIGS. 5-7). In this case there is a very high protection due to the combination of the two systems, so the full system renewal does not necessarily have to take place in each washing cycle. A partial renewal can be performed in between.

The overall decay is generally illustrated with line 16.

In the middle illustration situation there is shown a situation where only a physical or chemical barrier is applied in accordance with any of the FIGS. 1-2. In this case the protective effect is not as strong, so two washing cycles including application of a method according to the invention during one operation interval are necessary for appropriate renewal.

In the bottom illustration there is shown a situation where only a chemical barrier is applied (see FIG. 4). In this case the protective effect is consumed rather quickly and it is appropriate to renew the reactive substance in each washing cycle.

The arrow as well as the slope show that the degradation of the performance of the protection is the fastest in the lower graph and is slower the two upper graphs of FIG. 9. FIG. 9 is an example of strong erosive conditions showing how the product can be used modularly with respect to the type of layer deposition (chemical barrier as displayed in FIG. 1, 2, 3, 4, physical barrier as displayed in FIG. 1, 2, 3, a combination of both FIG. 5, 6, 7). It also shows that, as illustrated in the lower graph, during each or during the majority of the washing cycles the method can be applied to renew the protection, in the middle graph only during every third washing cycle, in the upper graph only every five washing cycles.

Of course the renewal scheme and the chosen protection system as illustrated can and should be adapted as needed. If, for example, it is of primary importance to have a layer as thin as possible, even in a situation where a combination of a physical barrier and a reactive barrier is used, each washing cycle might be used for the renewal. Equivalently, if the contamination in the system is severe, even for the situation where a combination of physical and chemical barrier is used, the method might be used for each washing cycle. Therefore, methods in accordance with the invention can be adapted to all conditions (erosion, contaminants etc) and all standard operating modes (frequency of the washing etc).

List of reference numerals

| | |
|---|---|
| 1 | base metal |
| 2 | bond coat |
| 3 | thermal barrier coating |
| 4 | pores |
| 5 | infiltrated area |
| 6 | top coat |
| 7 | anchored reactive substances |
| 8 | lower surface |
| 9 | upper surface |
| 10 | protection |
| 11 | protection level as a function of time using a method according to the invention |
| 12 | end of operation interval |
| 13 | engine operation between washing cycles |
| 14 | washing cycle |
| 15 | protection level as a function of time according to the state-of-the-art |
| 16 | degradation slope |
| 17 | x% of the degradation of the protection compared to the initial value |
| S | thickness of top coat |
| T | thickness of infiltration zone |
| Z | thickness of thermal barrier coating |
| p | protection level |
| t | time |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A method for the application and/or renewal of a protection for a thermal barrier coating system of a heat engine, said thermal barrier coating system including a bond coat layer and a thermal barrier coating layer having a porous structure, wherein the bond coat layer is located between and in contact with a base metal of a heat engine component and the thermal barrier coating layer, the bond coat bonding the thermal barrier coating layer to the base metal, the method comprising:

applying at least one substance inside the engine as a liquid or carried by a liquid by spraying and/or by flowing said liquid across an upper, hot-gas-exposed surface of the thermal barrier coating layer of the heat engine component mounted within the heat engine in an assembled state prior to an initial start-up of the engine, or between two operation intervals of the heat engine, or during a washing cycle of the heat engine, or combinations thereof;

wherein the at least one substance covers, partly penetrates into, or both, said porous structure, and wherein the at least one substance concomitantly or subsequently hardens and remains on the upper surface of the thermal barrier coating layer, within the pores of the thermal barrier coating layer, or both;

wherein applying comprises applying with turbine engine washing equipment.

2. A method according to claim 1, wherein the at least one substance comprises a sealing substance or a reactive substance or a combination or mixture thereof.

3. A method according to claim 1, wherein said applying the at least one substance is performed at at least one of the ends of an operation interval, just before a subsequent operation interval, and after or during at least one washing cycle.

4. A method according to claim 3, wherein said applying comprises applying according to a washing schedule of the engine.

5. A method according to claim 4, wherein said applying comprises applying during at least a majority of washing cycles of said washing schedule, before the start of a subsequent operation interval, or both.

6. A method according to claim 1, wherein said applying comprises applying the at least one substance during a washing cycle after at least one turbine washing.

7. A method according to claim 1, wherein the washing cycle comprises at least partly shutting down the engine, cooling down the engine, and turbine washing; and wherein applying at least one substance comprises injecting a liquid comprising said at least one substance into the turbine; and subsequently restarting the engine.

8. A method according to claim 7, further comprising:

repeating said applying and said restarting for at least one washing cycle within one operation interval.

9. A method according to claim 7, wherein injecting a liquid comprises injecting a reactive substance, a sealing substance, or both.

10. A method according to claim 9, further comprising:

changing the frequency of said injecting based on the speed of consumption of said protection.

11. A method according to claim 7, wherein injecting a liquid comprises injecting with turbine washing equipment.

12. A method according to claim 1, wherein the washing cycle comprises at least partly shutting down the engine, cooling down the engine, and turbine washing; and subsequently injecting a liquid comprising at least one reactive substance, at least one sealing substance, or both, into the turbine; and subsequently restarting the engine; and during a subsequent washing cycle, injecting a liquid comprising at least one other substance, said at least one other substance comprising a sealing substance or a reactive substance.

13. A method according to claim 12, wherein injecting comprises injecting with turbine washing equipment.

14. A method according to claim 12, further comprising:

repeating said injecting and said restarting for at least one washing cycle until the performance of at least one of the physical layer and the chemical layer is affected.

15. A method according to claim 12, wherein said injecting during a subsequent washing cycle comprises injecting after a turbine washing.

16. A method according to claim 1, wherein:

the sealing substance, the reactive substance, or both, is self-hardening; or the sealing substance, the reactive substance, or both, hardens under the influence of exposure to air, heat, irradiation, hardening agents, or a combination thereof.

17. A method according to claim 16, wherein exposure to heat comprises flame treatment or resistive heating.

18. A method according to claim 16, wherein exposure to irradiation comprises exposure to UV and/or IR irradiation.

19. A method according to claim 1, wherein the at least one substance is in the form of sol-gel, slurry, emulsion, dispersion, solution, or a mixture thereof.

20. A method according to claim 1, wherein:

said at least one substance comprises at least one hardening agent selected from the group of an initiator, a curing agent, a cross-linker, and inorganic precursors; and said at least one substance is carried by a carrier liquid comprising at least one of an aqueous solvent and an organic solvent.

21. A method according to claim 1, wherein the at least one substance is based on a polymeric, oligomeric, or monomeric material.

22. A method according to claim 1, wherein the liquid is capable of allowing an optical verification of the level of protection or of the presence, extent, or homogeneity of the protection.

23. A method according to claim 1, wherein the liquid comprises a colored indicator.

24. A heat engine component comprising:

a base metal;

a thermal barrier coating system on the base metal, the thermal barrier coating system comprising a bond coat layer and a thermal barrier coating layer having a porous structure, wherein the bond coat layer is located between and in contact with the base metal and the thermal barrier coating layer and bonds the thermal barrier coating layer to the base metal, wherein the thermal barrier coating layer has an outer, hot-gas-exposed surface;

at least one substance comprising at least one of a hardened sealing substance and a reactive substance, said at least one substance covering, at least partially infiltrating, or both, said porous structure at said upper surface, said at least one substance having been hardened from a liquid sprayed onto or flowed across said upper surface of the thermal barrier coating layer on the hot engine component when mounted within the engine;

wherein said at least one substance has been spraying or flowed with engine washing equipment.

25. A heat engine component according to claim 24, wherein the at least one substance infiltrates the porous structure to a penetration thickness T at least equal to the thickness which has been eroded in between two washing cycles.

26. A heat engine component according to claim 25, wherein said thickness T is less than 30% of the total thickness Z of the thermal barrier coating layer.

27. A heat engine component according to claim 24, wherein the at least one substance comprises a physical and/or chemical barrier layer above the upper surface of the thermal barrier coating layer.

28. A heat engine component according to claim 27, wherein the thickness S of the at least one substance extending above the upper surface of the thermal barrier coating layer is between 2%-35% of the total thickness Z of the thermal barrier coating layer.

29. A heat engine component according to claim 27, wherein the thickness S of the at least one substance extending above the upper surface of the thermal barrier coating layer is between 2%-25% of the total thickness Z of the thermal barrier coating layer.

30. A heat engine component produced by a method according to claim 1.

31. A method of operating a heat engine, the method comprising:

providing a heat engine having an internal heat engine component according to claim 30; and operating said heat engine with crude or heavy oil.

32. A method according to claim 31, wherein said oil comprises additives.

33. A method according to claim 31, wherein operating said heat engine comprises operating with sand ingestion.

34. A method according to claim 31, wherein operating said heat engine comprises operating with air or water containing salts, industrial contaminants, or both.

35. A method according to claim 31, wherein operating said heat engine comprises restarting said heat engine, and wherein hardening of said at least one substance is performed by heat generated by said restarting.

* * * * *